US011670832B2

(12) United States Patent
Deleniv et al.

(10) Patent No.: US 11,670,832 B2
(45) Date of Patent: Jun. 6, 2023

(54) TUNABLE RESONANCE CAVITY

(71) Applicant: Telefonaktiebolaget LM Ericsson (publ), Stockholm (SE)

(72) Inventors: Anatoli Deleniv, Molndal (SE); Ola Tageman, Gothenburg (SE)

(73) Assignee: TELEFONAKTIEBOLAGET LM ERICSSON (publ), Stockholm (SE)

( * ) Notice: Subject to any disclaimer, the term of this patent is extended or adjusted under 35 U.S.C. 154(b) by 376 days.

(21) Appl. No.: 16/648,280

(22) PCT Filed: Oct. 18, 2017

(86) PCT No.: PCT/EP2017/076649
§ 371 (c)(1),
(2) Date: Mar. 18, 2020

(87) PCT Pub. No.: WO2019/076457
PCT Pub. Date: Apr. 25, 2019

(65) Prior Publication Data

US 2020/0287266 A1 Sep. 10, 2020

(51) Int. Cl.
*H01P 7/06* (2006.01)
*H01P 1/207* (2006.01)

(52) U.S. Cl.
CPC ..... *H01P 7/06* (2013.01); *H01P 1/207* (2013.01); *H01P 7/065* (2013.01)

(58) Field of Classification Search
CPC .... H01P 7/06; H01P 7/065; H01P 7/00; H01P 1/207; H01P 1/2088
See application file for complete search history.

(56) References Cited

U.S. PATENT DOCUMENTS

| | | | |
|---|---|---|---|
| 6,049,308 | A | 4/2000 | Hietala et al. |
| 2004/0189527 | A1 | 9/2004 | Killen et al. |
| 2011/0248891 | A1 | 10/2011 | Han et al. |
| 2012/0098706 | A1 | 4/2012 | Lin et al. |
| 2014/0198004 | A1 | 7/2014 | Richards et al. |
| 2015/0303576 | A1 | 10/2015 | Latrach et al. |

FOREIGN PATENT DOCUMENTS

| | | | |
|---|---|---|---|
| CN | 1784809 | A | 6/2006 |
| CN | 101317299 | A | 12/2008 |
| CN | 102394378 | A | 3/2012 |

(Continued)

OTHER PUBLICATIONS

Chinese Office Action dated Feb. 3, 2021 in connection with Chinese Application No. 201780095952.8, 9 pages.

(Continued)

*Primary Examiner* — Stephen E. Jones
(74) *Attorney, Agent, or Firm* — Leffler Intellectual Property; Kenneth B. Leffler

(57) ABSTRACT

A resonance cavity comprising a first layer of dielectric material having a first dielectric constant and a first thickness, a second layer of dielectric material having a second dielectric constant different from the first dielectric constant and a second thickness, a metal patch arranged between the first and the second layer of dielectric material, and an electromagnetically shielded enclosure having at least one aperture, the electromagnetically shielded enclosure arranged to enclose part of the first and second layers of dielectric material and the metal patch.

15 Claims, 10 Drawing Sheets

(56) References Cited

FOREIGN PATENT DOCUMENTS

| | | | |
|---|---|---|---|
| CN | 102394378 | B | 1/2014 |
| CN | 105006652 | A | 10/2015 |
| CN | 105071051 | A | 11/2015 |
| CN | 106887690 | A | 6/2017 |
| CN | 107069201 | A | 8/2017 |
| CN | 107230841 | A | 10/2017 |
| WO | 2019076456 | A1 | 4/2019 |

OTHER PUBLICATIONS

English language translation of Chinese Office Action dated Feb. 3, 2021 in connection with Chinese Application No. 201780095952.8, 4 pages.

Montiel, Claudio M., "A Novel Active Antenna with Self-Mixing and Wideband Varactor-Tuning Capabilities for Communication and Vehicle Identification Applications", IEEE Transactions on Microwave Theory and Techniques, vol. 44, No. 12, Dec. 1996, pp. 2424-2430.

PCT International Search Report, dated Jul. 13, 2018, in connection with International Application No. PCT/EP2017/076649, all pages.

PCT Written Opinion, dated Jul. 13, 2018, in connection with International Application No. PCT/EP2017/076649, all pages.

Montiel, C.M et al., "A Novel Active Antenna with Self-Mixing and Wideband Varactor-Tuning Capabilities for Communication and Vehicle Identification Applications", IEEE Transactions on Microwave Theory and Techniques, vol. 44, No. 12, Dec. 1996, pp. 2421-2430.

Curtis, J.A. et al., Multi-Layered Planar Filters on Aperture Coupled, Dual Mode Microstrip or Stripline Resonators, Microwave Symposium Digest, 1992, IEEE MTT-S International, Albuguerque, NM, USA, Jun. 1-5, 1992, pp. 1203-1206.

Chinese Office Action dated Sep. 28, 2022 in connection with Chinese Application No. 201780095952.8, 5 pages (Document Relevance codes in English).

(a)

(b)

(a)

(b)

(a)

(b)

TUNABLE RESONANCE CAVITY

TECHNICAL FIELD

The present disclosure relates to resonance cavities for use in radio frequency signal filtering arrangements.

BACKGROUND

Antenna elements are devices configured to emit and/or to receive electromagnetic signals such as radio frequency (RF) signals used for wireless communication. Practical implementation of signal filtering functions for such antenna elements is a challenging task. It is for instance difficult to achieve a wide bandwidth of the antenna and filter combination, which is essential in order to have good production margins with respect to dimensional tolerances, and at the same time achieve antenna and filter combinations having high rejection characteristics at specified frequencies where interference or leakage of radio frequency (RF) power may occur. Microstrips and slot resonators are sometimes used to construct filters for antenna elements. However, low Q-factors of the microstrip or slot resonators cause an increased level of insertion loss. Also, traditional filters are typically designed as if they were isolated, which leads to a reduction of the antenna element bandwidth.

Reliability and cost requirements call for use of printed circuit board (PCB) technology. Using PCB technology TEmnO resonance cavities may be realized by electromagnetically shielding a section of a PCB. Implementation of a filter using a plurality of resonance cavities requires adjustment of the resonance frequencies of the cavities. Parameters that affect the resonance frequency of a resonance cavity include permittivity and a lateral size of the cavity, i.e., the size of the cavity. However, PCB materials are often only available in certain pre-determined permittivity values. Thus, for a fixed dimension of the electromagnetical shielding, the flexibility of tuning the resonance frequencies of cavities becomes limited to available PCB materials, i.e., selectable permittivity. If a material with the desired permittivity is not available, the size of the electromagnetical shielding must be altered to change resonance frequency, which changes footprint.

SUMMARY

An object of the present disclosure is to provide improved resonance cavities and methods which seek to mitigate, alleviate, or eliminate one or more of the above-identified deficiencies in the art and disadvantages singly or in any combination and to enable improved filter arrangements, antenna elements, antenna arrays, and wireless devices.

This object is obtained by a resonance cavity comprising a first layer of dielectric material associated with a first dielectric constant and a first thickness, and a second layer of dielectric material associated with a second dielectric constant different from the first dielectric constant and a second thickness. A metal patch having a shape is arranged between the first and the second layer of dielectric material. An electromagnetically shielded enclosure having at least one aperture is arranged to enclose part of the first and second layers of dielectric material and the metal patch, whereby the shape of the metal patch affects a resonance frequency of the resonance cavity.

There are many advantages associated with the proposed resonance cavity;

Resonance cavities may be realized in standard PCB materials. This provides for low cost and reliable implementation, which is an advantage.

The disclosed resonance cavity contains at least two dielectric material layers. The permittivity and thickness of layers, together with the electromagnetically shielded enclosure determines the resonance frequency. Most of PCB materials are available only in a few select thicknesses and permittivity options, thus limiting design choices when it comes to resonance frequency of a cavity. However, due to the introduction of the metal patch, it becomes possible to tune the resonance frequency not only by changing the dielectric permittivity and thickness of the PCB layers, but also changing the shape of the metal patch. This expands design options when it comes to resonance frequency, which is an advantage.

Also, the disclosed resonance cavities may be arranged in multiple layers on top of each other, which enables design of compact size and low cost filter arrangements, which is an advantage.

According to some aspects, the electromagnetically shielded enclosure comprises side walls defined by a plurality of via-holes, a topmost metallization layer applied to the first layer of dielectric material and a bottommost metallization layer applied to the second layer of dielectric material.

According to other aspects, the electromagnetically shielded enclosure comprises a metallized side wall or a metallized trench, a topmost metallization layer applied to the first layer of dielectric material and a bottommost metallization layer applied to the second layer of dielectric material The via-holes, metallized side walls or metallized trenches provide for low cost electromagnetical shielding which can be shared between stacked resonance cavities such that all stacked cavities share the same enclosure structure.

According to further aspects, the metal patch has a variable shape controllable from an exterior of the resonance cavity. This way the resonance frequency can be adjusted after production, which allows for calibration of the resonance frequencies and enables variable filter functions. In particular, the metal patch may comprise an electrical conduit connecting the metal patch to an electrical component, such as a varactor, configured exterior to the resonance cavity. This way the shape of the metal patch can be varied from outside the resonance cavity.

There are also disclosed herein filter arrangements, antenna elements, antenna arrays, and wireless devices comprising the disclosed resonance cavity.

There is also disclosed herein a method for tuning a resonance frequency of a resonance cavity. The method comprises selecting a first dielectric constant and a second dielectric constant different from the first dielectric constant, selecting a first and a second dielectric material thickness, selecting a metal patch shape, and configuring a first layer of dielectric material having the first dielectric constant and the first thickness, a second layer of dielectric material having the second dielectric constant and the second thickness, with a metal patch interspersed between the first and the second dielectric layer having the selected metal patch shape, and an electromagnetically shielded enclosure having at least one aperture. The electromagnetically shielded enclosure arranged to enclose part of the first and second layers of dielectric material and the metal patch.

The filter arrangements, antenna elements, antenna arrays, wireless devices and methods display advantages corresponding to the advantages already described in relation to the resonance cavities.

BRIEF DESCRIPTION OF THE DRAWINGS

Further objects, features, and advantages of the present disclosure will appear from the following detailed description, wherein some aspects of the disclosure will be described in more detail with reference to the accompanying drawings, in which.

DETAILED DESCRIPTION

Figure 1:
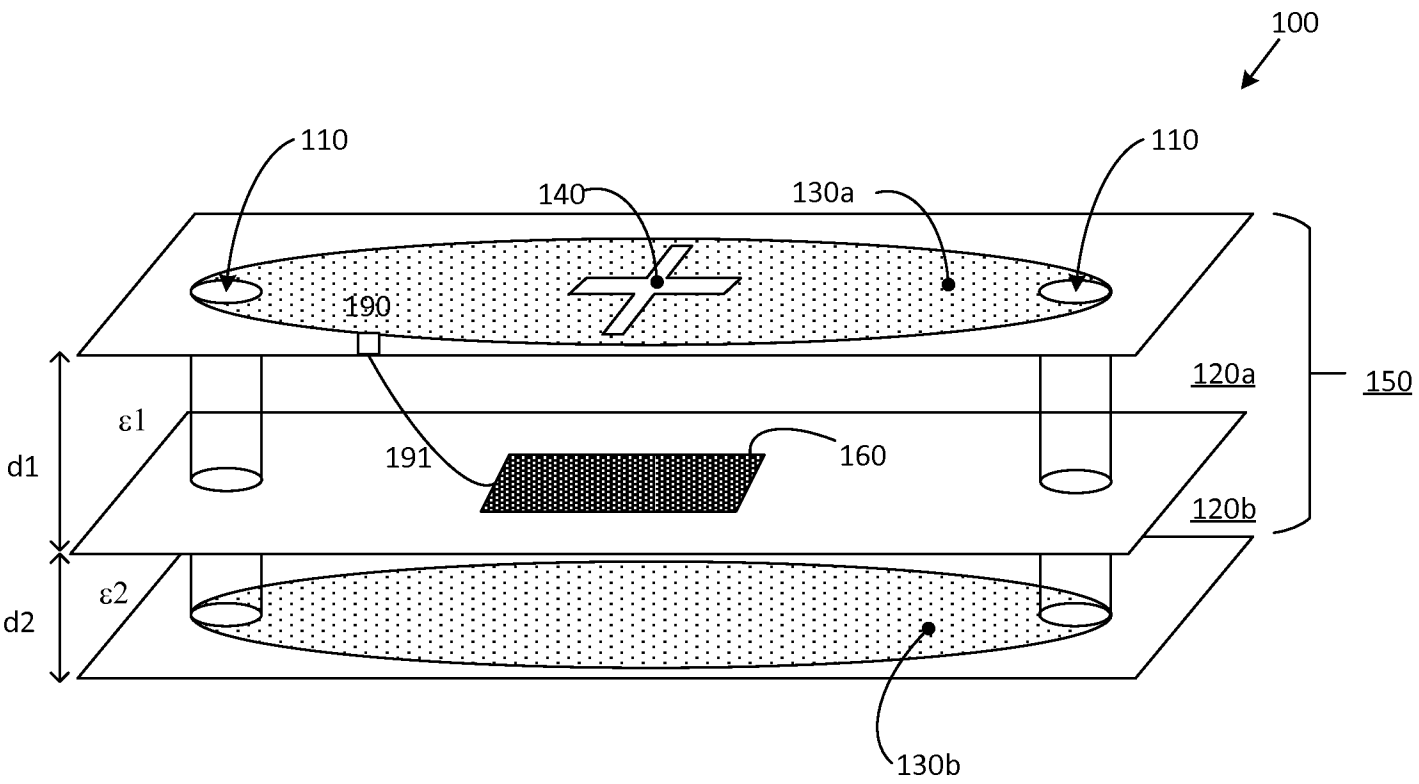
FIGS. 1-2 illustrate resonance cavities according to embodiments.

FIG. 1 illustrates a resonance cavity 100. The resonance cavity comprises a first layer of dielectric material 120*a* associated with a first dielectric constant ε1 and a first thickness d1 and a second layer of dielectric material 120*b* associated with a second dielectric constant ε2 different from the first dielectric constant and a second thickness d2. As mentioned above, PCB production is often limited in choice to a few different PCB materials, having different dielectric constants such as permittivity. Usually there are also a few select choices of PCB material thickness available.

A metal patch 160 having a shape is arranged between the first and the second layer of dielectric material. It is appreciated that the metal patch shape is determined by the geometrical shape of the metal patch, and is according to some aspects also determined by the electrical properties of the metal patch.

The resonance cavity is delimited by an electromagnetically shielded enclosure 110, 130*a*, 130*b* having at least one aperture 140. The electromagnetically shielded enclosure is arranged to enclose part of the first and second layers of dielectric material and the metal patch, thus delimiting the cavity. In FIG. 1, only two via-holes are shown. It is however, appreciated that an electromagnetical shielding normally comprises additional via-holes, or is constructed by other means as will be further discussed below.

Design of the resonance cavity for use in, e.g., a filter arrangement involves making design choices of parameters of the cavity in order to achieve a certain desired resonance frequency or overall frequency characteristic or frequency response of the resonance cavity. The dielectric constants and other properties of the first and second layers of dielectric material will affect the resonance frequency of the cavity. The size and shape of the volume delimited by the electromagnetical shielding also contributes to determining the resulting resonance frequency. This is where the limited choices of selectable PCB materials and thicknesses becomes problematic. The discrete options for material and thickness means that only certain resonance frequencies may be obtained for a given enclosed volume. Naturally, such limitation in design is not preferred. However, the metal patch 160 interspersed between layers also affects the resonance frequency, since the shape of the metal patch affects the resonance frequency of the resonance cavity, as will be further explained in connection to FIG. 6 below.

Thus, a design process to achieve a preferred resonance frequency of a resonance cavity according to the present disclosure may involve selecting materials and thicknesses for the first and second layer. Given a configuration of the electromagnetic shielding, i.e., the geometrical configuration of the enclosed volume, a resonance frequency is obtained. Materials and thicknesses can be selected to achieve a resonance frequency close to the desired resonance frequency. The shape of the metal patch can then be determined to fine-tune the resonance frequency to the desired value, or within an acceptable range around the desired resonance frequency value. This way, a continuous range is achievable resonance frequencies can be obtained despite limited choices of PCB materials and thicknesses, which is an advantage.

It is appreciated that design of the resonance cavity, i.e., selection of the above-mentioned parameters such as dielectric constants, thicknesses, and metal patch shapes, can be performed using computer simulation, by analytical computation, or by practical experimentation and measurements.

According to aspects, the opening 140 illustrated in FIG. 1 can be configured as an aperture of the resonance cavity. The aperture can be used for varying purposes. For instance, the aperture can function as an antenna element. In this case the aperture is arranged to transmit and/or to receive electromagnetic signals to and from an exterior of the resonance cavity. The opening 140 in FIG. 1 has the shape of a cross. It is, however, appreciated that this cross shape is merely an example shape. Other shapes are equally possible, such as circular shapes, rectangular shapes, irregular shapes and regular shapes having rotational symmetries. The effect of using differently shaped apertures can be determined using computer simulation, by analytical computation, or by practical experimentation and measurements.

A drawback of the resonance cavity discussed above is that the resonance frequency of the cavity is fixed once the PCB layers and metal patch have been sandwiched in production. In some scenarios, it is preferred to be able to calibrate or otherwise adjust the frequency characteristics of a resonance cavity after production. To achieve such functionality, the metal patch, according to some aspects, has a variable shape controllable from an exterior of the resonance cavity.

There are multiple possible implementation options for providing a metal patch with a shape variable from an exterior of the resonance cavity.

According to one aspect, the metal patch is arranged in two sections slidably configured with respect to each other, and a rod or other control means attached to one section and extending to an exterior of the resonance cavity. Thus, by the metal rod or other control means, the shape of the metal patch may be altered after production.

According to some aspects, the shape of the metal patch is altered electronically to vary an electrical shape of the patch. In this case the metal patch is electrically connected via conduit 191 to an electrical component 190 arranged at an exterior of the resonance cavity. The electrical component is configured to alter an equivalent electrical size of the metal patch. The electrical component may for instance comprise a varactor or other tunable electric component that affects the electromagnetic properties of the metal patch inside the resonance cavity. The electrical component may further comprise a control unit to adjust the electrical size of the metal patch based on an external control signal.

Electromagnetic shielding is the practice of reducing the electromagnetic field in a space by blocking the field with barriers made of conductive or magnetic materials.

Figure 2:
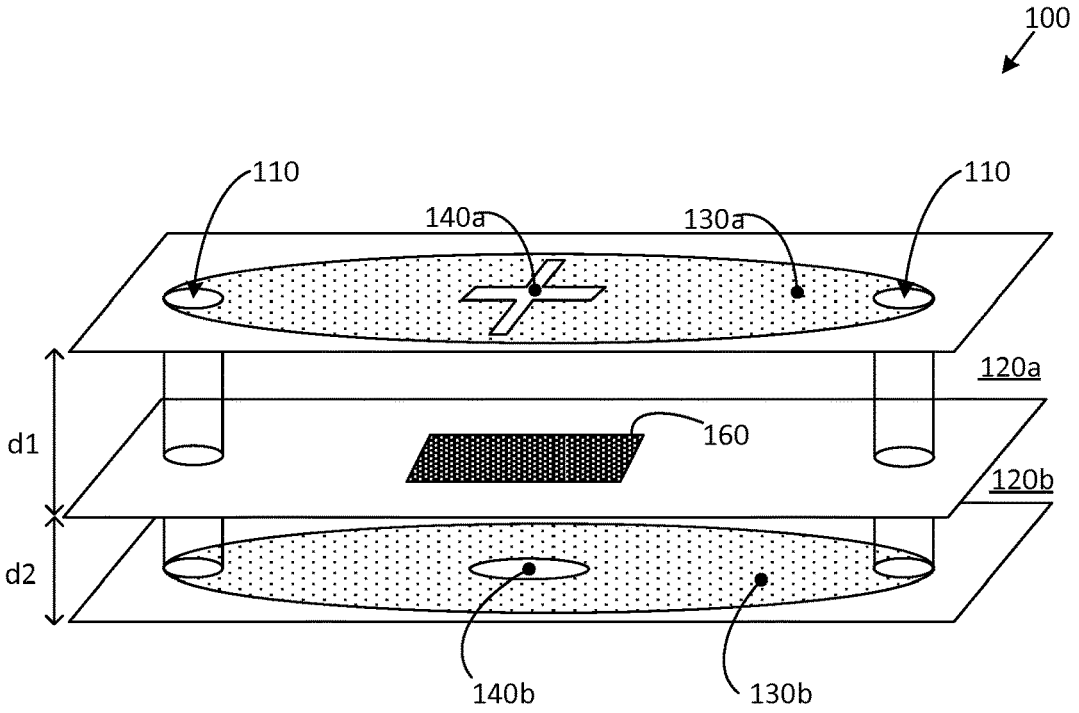
Figure 2:
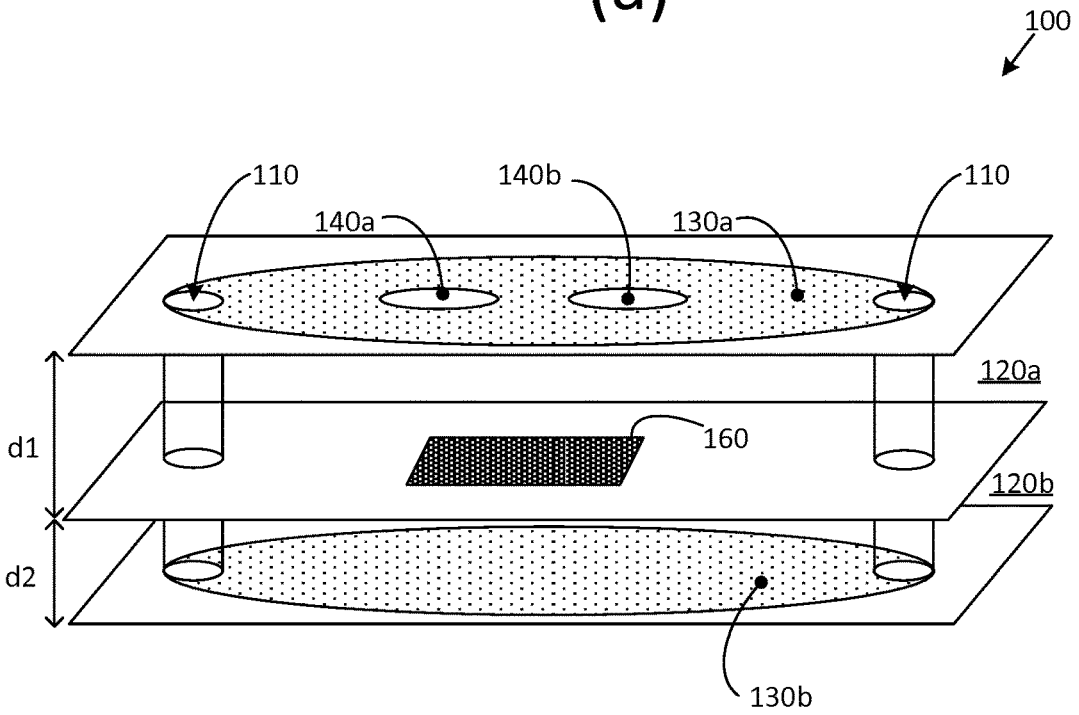

FIG. 2 illustrates two resonance cavities. The resonance cavity illustrated in FIG. 2*a* comprises first 140*a* and second 140*b* openings or apertures. This configuration allows the resonance cavity to interface in two directions. According to some aspects, the resonance cavity may be configured as one layer 150 in a multilayer stack of resonance cavities. In this case the first aperture 140*a* interfaces with a resonance cavity disposed at one side of the resonance cavity, and the second aperture 140*b* interfaces with another resonance cavity disposed at another side of the resonance cavity.

One of the apertures may, according to some aspects, also function as an antenna element arranged to receive and/or to emit electromagnetic energy from and to an exterior of the resonance cavity.

FIG. 2*b* illustrates aspects of the disclosed resonance cavity where two openings or apertures 140*a*, 140*b* are arranged in the same metallization layer 130*a*. In general, the electromagnetic shielding may comprise any number of apertures configured as antenna elements or interfaces to an exterior of the resonance cavity. In particular, the resonance cavity may be configured to receive a plurality of input signals, such as radio frequency signals having orthogonal polarizations, i.e., horizontal and vertical polarizations.

Figure 3:
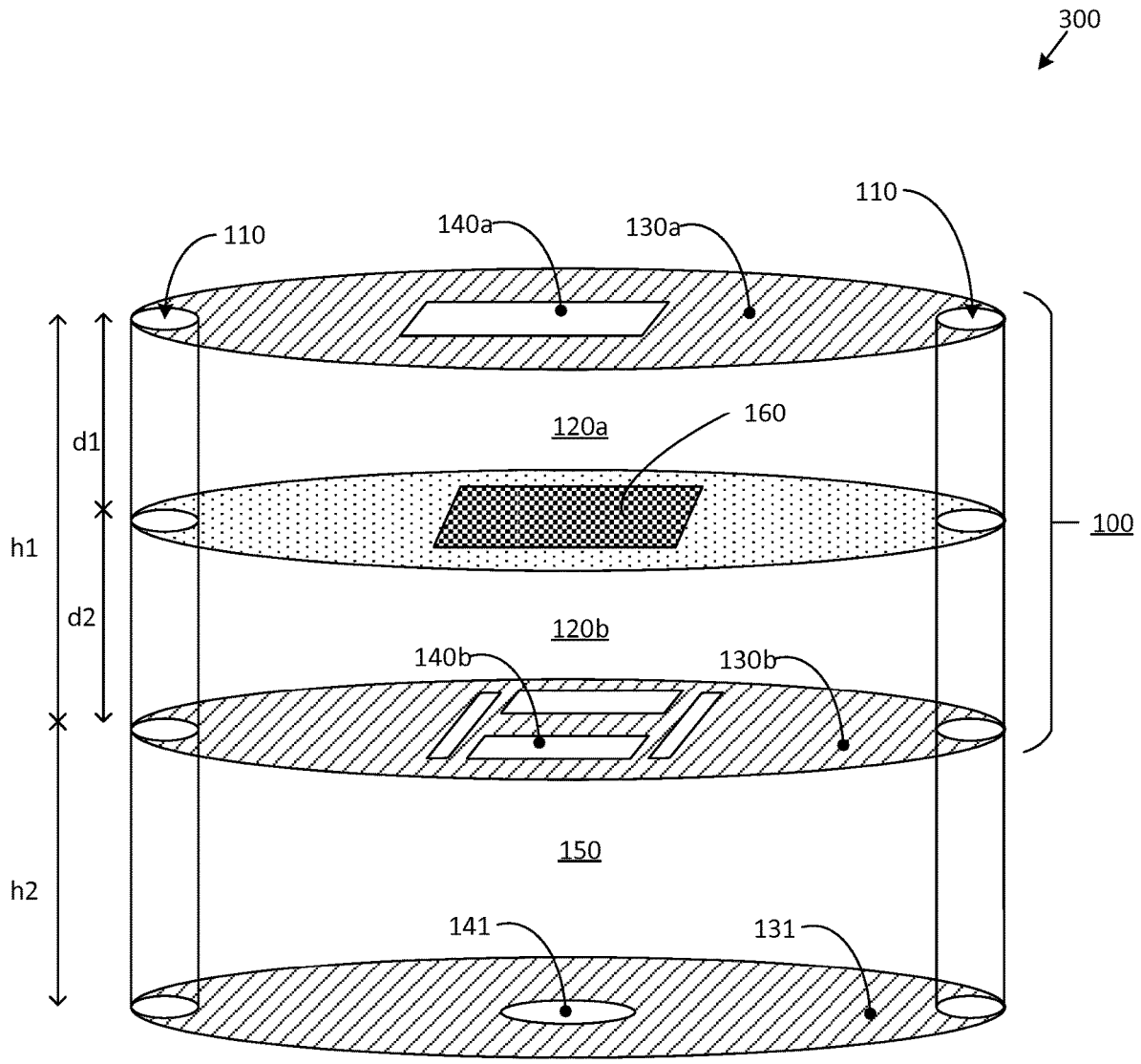
FIGS. 3-4 illustrate filter arrangements according to embodiments.

FIG. 3 illustrates a filter arrangement 300 comprising resonance cavities according to aspects. In FIG. 3 several resonance cavities 100, 150 have been stacked and are delimited or enclosed by common via-holes 110. As previously noted other options exist to replace the via-holes. For instance, a metallized sidewall or metallized trench may be used to design the electromagnetical shielding. It is further noted that all resonance cavities in the filter arrangement share the same electromagnetical shielding, i.e., the same set of via-holes or metallized sidewalls, or metallized trench.

One of the resonance cavities 150 has an aperture 141 arranged as signal input to the filter arrangement 300. This resonance cavity interfaces to another resonance structure 120*a*, 120*b* via apertures 140*b*. This resonance structure is a two-layer resonance cavity 100 with characteristics tunable by means of the metal patch 160, as discussed in connection to FIG. 1. The topmost aperture 140*a* in the two-layer resonance cavity here functions as output interface of the filter arrangement.

The PCB materials, and the geometrical configuration h1, h2, d1, d2, as well as the shape of the metal patch 160 together at least partly determine the frequency characteristics of the filter arrangement.

Consequently, in addition to the resonance cavities, there is disclosed herein a filter arrangement 300 comprising a resonance cavity according the disclosure.

There is also disclosed herein an antenna element comprising the filter arrangement 300.

Figure 4:
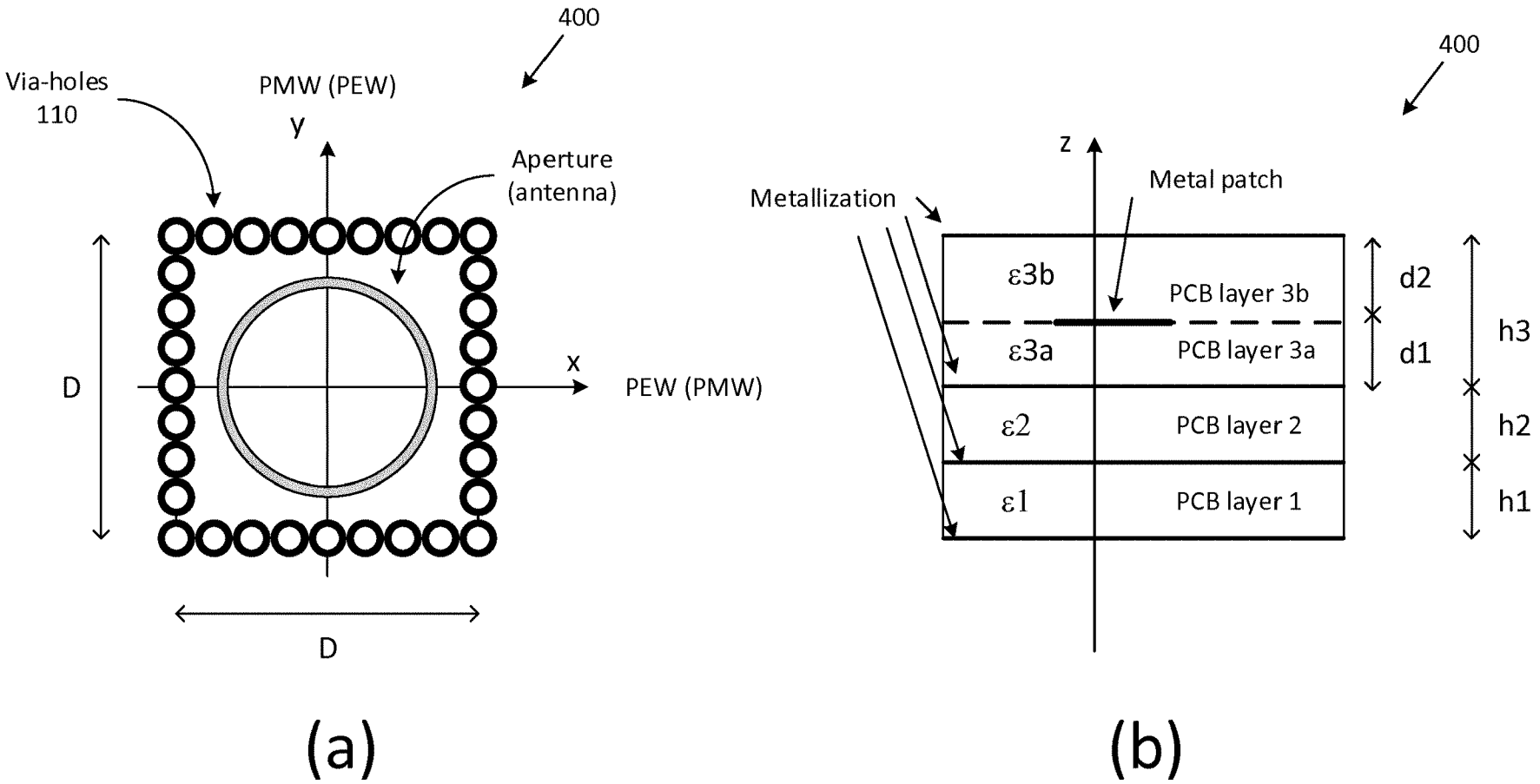

FIG. 4 illustrates a filter arrangement 400. In FIG. 4 a full set of via holes 110 are shown, which serve as part of the electromagnetical shielding.

A top and a side view of a filter arrangement with size D is shown in FIGS. 4*a* and 4*b*, respectively. Each unit cell is delimited by via holes 110 at its circumference interconnecting all the layers of the integrated filter structure, thus forming its side walls. The upper layer with thickness h3 may according to aspects be close to a quarter of a wavelength of a frequency band of operation. In case the filter structure is integrated with an antenna element, an aperture in the topmost metallization layer forms a cavity-backed antenna element.

Below the layer containing antenna element, PCB layer 3*a* and PCB layer 3*b*, there are a few other layers separated by metallization. Together with side walls defined by via holes, each layer contains a well-defined cavity that operates at TEmk0 mode(s), where m,k,0 corresponds to a number of half-wavelengths along x-, y- and z-axes respectively. The resonance frequency of every cavity is defined by its lateral size and dielectric constants such as permittivity of the PCB layer hosting it. With a limited choice of PCB materials and fixed cavity sizes due to the shared via-holes, the filter-antenna is practically difficult to realize since there is no effective means to adjust the dielectric permittivity of the host layers and consequently the resonance frequency. It is appreciated that for TEmk0 cavity modes the field is homogeneous along z-axes, and an introduction of metal loading at any plane x-y, does not have any effect on the resonance frequency, since the electric field has only one component Ez which is normal to the metallization. However, since one layer has two different dielectric constants, resonance frequency tuning is possible.

Following the present disclosure, fine tuning of a multilayer cavity is achieved in two steps. First, two or more dielectric layers are used to form an equivalent cavity substrate. There are a few remarks to be made regarding this equivalent substrate of thickness h3 in FIG. 4*b*.

Due to the appearance of the extra PCB layer with different dielectric constant, additional components of the electrical field appear, Ex and Ey. Respective resonance modes are now classified as TM-to-z and TE-to-z.

It is evident that by choosing different combinations of layer thicknesses, it is possible to adjust resonance frequency of a k-th cavity over a wide range. On one side, this range is delimited by the permittivity the first layer and on the other side by the permittivity of the second layer.

PCB technology uses layers with discrete predefined thicknesses and in that follows that there is a discrete set of the resonance frequencies realizable for chosen materials that depend on the available thicknesses, i.e. smooth tuning of resonance frequency is still not achieved.

As mentioned above, using two or more layers to build a resonance cavity produces in-plane electric field components Ex and Ey. The higher the contrast is between the dielectric constants, the stronger these components are. In that follows that any metal patch introduced at the interface between these two layers will affect the structure of the field and consequently the resonance frequency of the cavity. Adjusting the size of the patch allows one to achieve smooth tuning of a chosen cavity.

Figure 5:
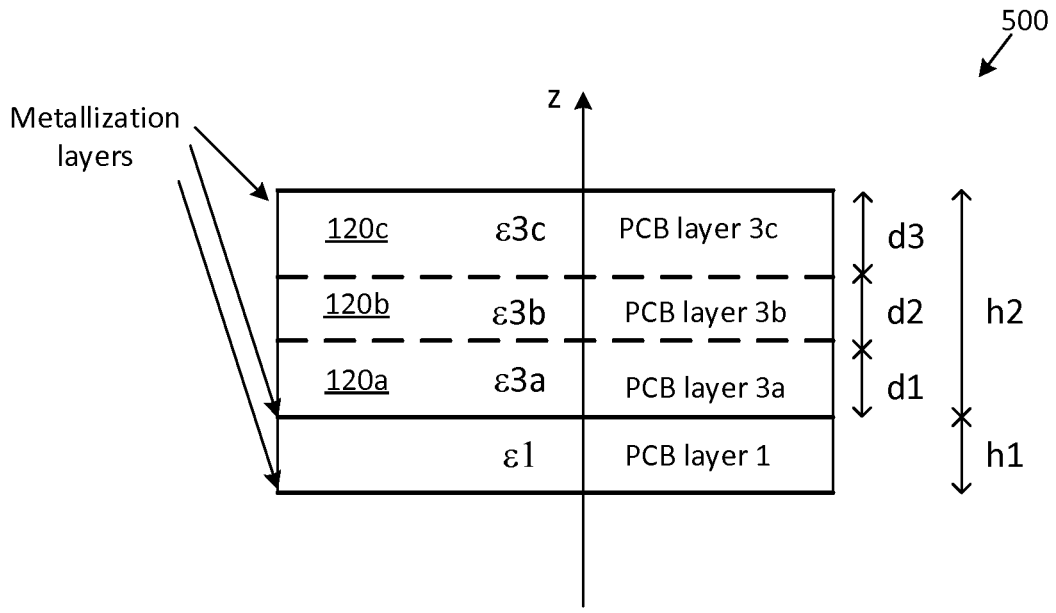
FIGS. 5-7 illustrate resonance cavities according to embodiments.
Figure 5:
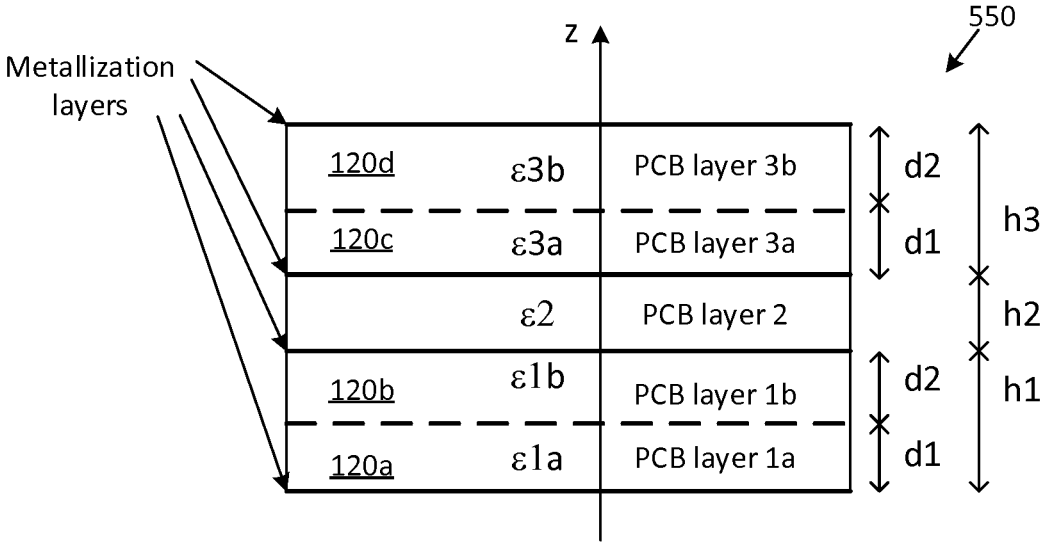

FIG. 5*a* illustrates a resonance cavity 500 comprising a third 120*c* layer of dielectric material, PCB layer 3*c*, associated with a third dielectric constant and a third thickness. A further metal patch is arranged between the second and the third layer of dielectric material. The electromagnetically shielded enclosure is arranged to enclose part of the first, second, and third layers of dielectric material, the metal patch and the further metal patch.

FIG. 5*b* illustrates another resonance cavity 550 comprising two separate two-layer cavities. A first such cavity 120*a*, 120*b* is arranged at the bottom of the structure and the other such cavity 120*c*, 120*d* is arranged at the top of the structure.

The examples of FIGS. 5*a* and 5*b* illustrate the versatile design options available by using the disclosed resonance cavity in stacked configurations with additional resonance cavities.

Figure 6:
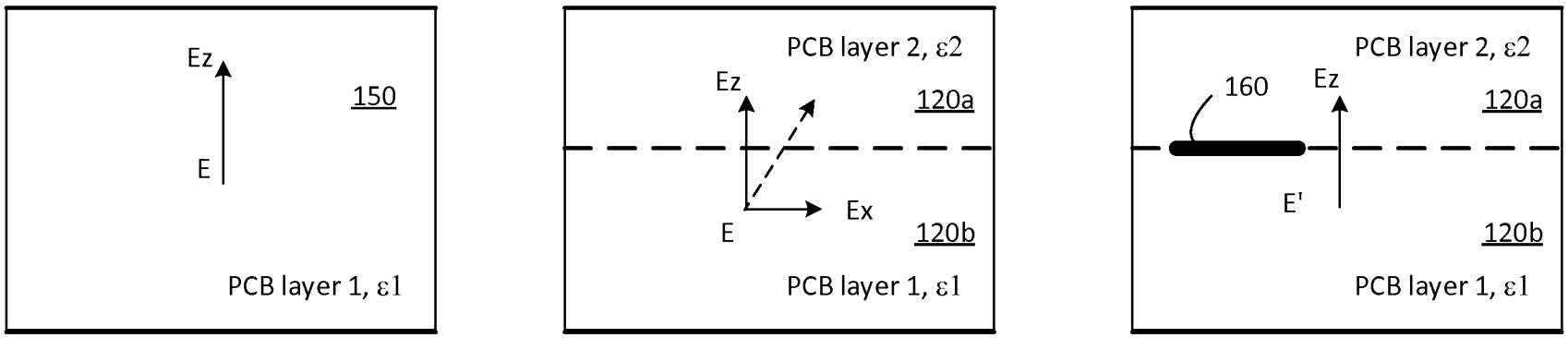

FIG. 6*a* shows an electric field E along a z-axis in a PCB layer 150. If the layer is divided into sublayers 120*a*, 120*b* as illustrated in FIG. 6*b*, the electrical field is affected causing field components to appear along other axes, here along an x- and y-axis. FIG. 6*c* illustrates the effects of introducing the metal patch 160. The additional field components are removed near to the patch, leaving an electric field with different magnitude compared to the field in FIG. 6*a*. Thus, FIG. 6 illustrates the physical effects of introducing a metal patch between two PCB layers of different material.

Figure 7:
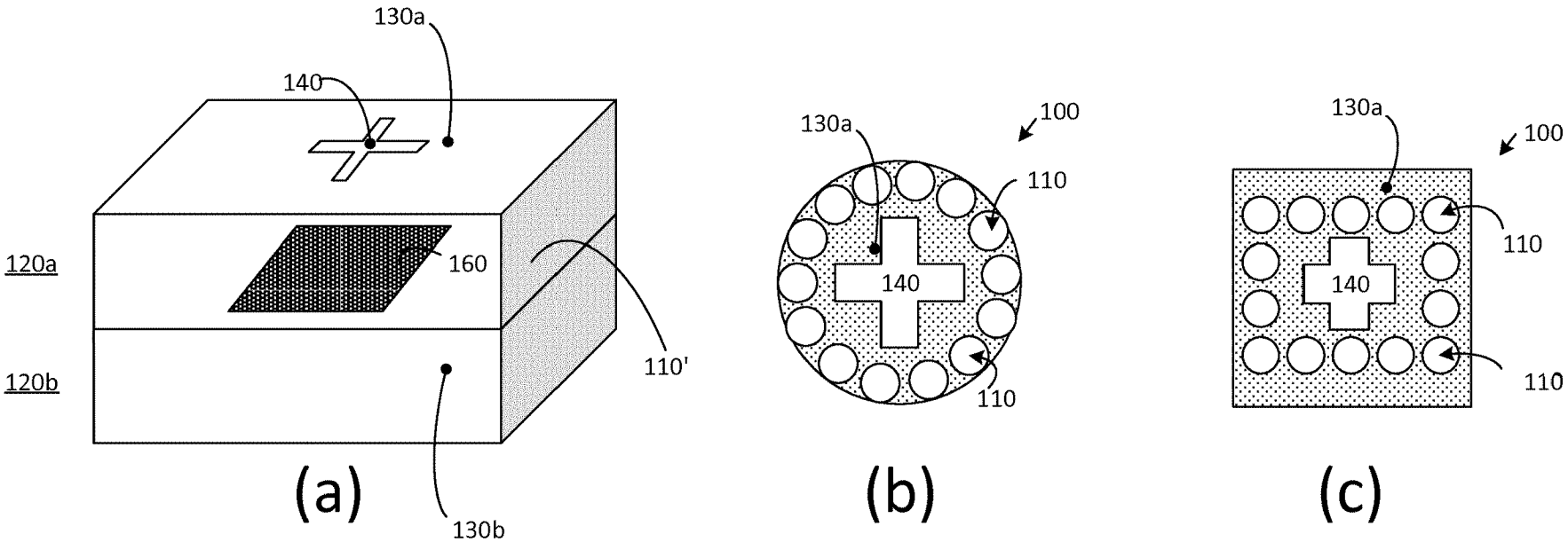

FIG. 7 illustrates resonance cavities having different side-wall arrangements, i.e., having different electromagnetical shielding arrangements.

In FIG. 7*a*, the electromagnetically shielded enclosure comprises a metallized side wall or a metallized trench 110' milled into the PCB material stack. A topmost metallization layer 130*a* applied to the first layer of dielectric material 120*a* and a bottommost metallization layer 130*b* applied to the second layer of dielectric material 120*b*.

In FIGS. 7*b* and 7*c*, the electromagnetically shielded enclosure comprises side walls defined by a plurality of via-holes 110. A topmost metallization layer 130*a* applied to the first layer of dielectric material 120*a* and a bottommost metallization layer 130*b* applied to the second layer of dielectric material 120*b*.

According to aspects, the electromagnetically shielded enclosure comprises a combination of via-holes and metallized side-walls or metallized trenches.

According to other aspects, the electromagnetically shielded enclosure is arranged to only partially shield an enclosed PCB volume, i.e., the electromagnetical enclosure does not totally seal the cavity.

Figure 8:
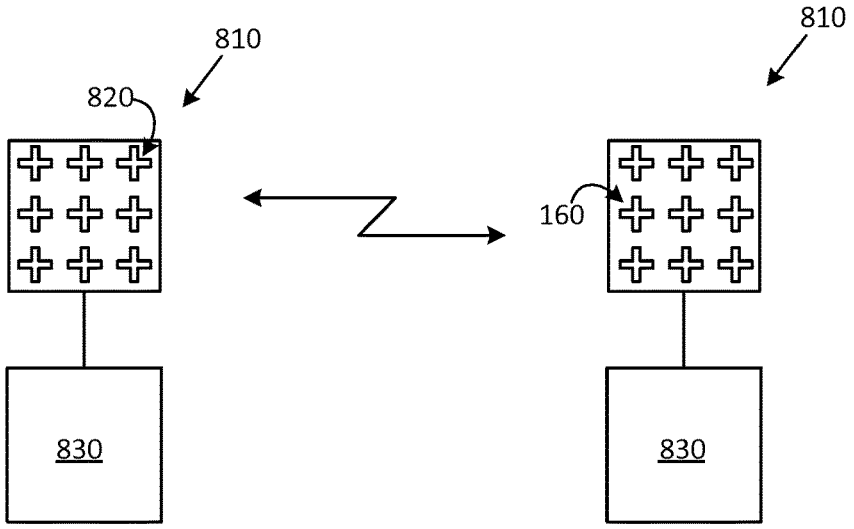
FIG. 8 illustrates network nodes and wireless devices with antenna arrays.
Figure 8:
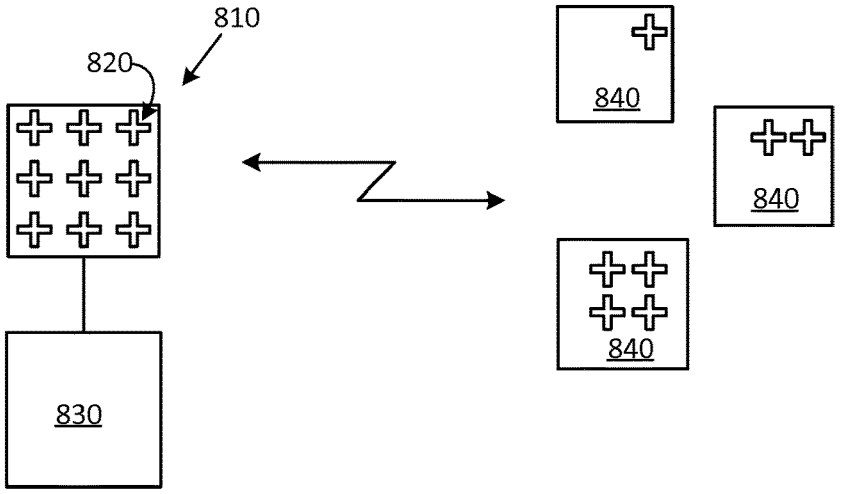

FIG. 8 illustrates network nodes and wireless devices with antenna arrays. There is shown antenna arrays 810 comprising a plurality of antenna elements as discussed herein. There is also shown, in FIG. 8*b*, wireless devices 840 comprising one or more antenna elements as discussed herein.

Figure 9:
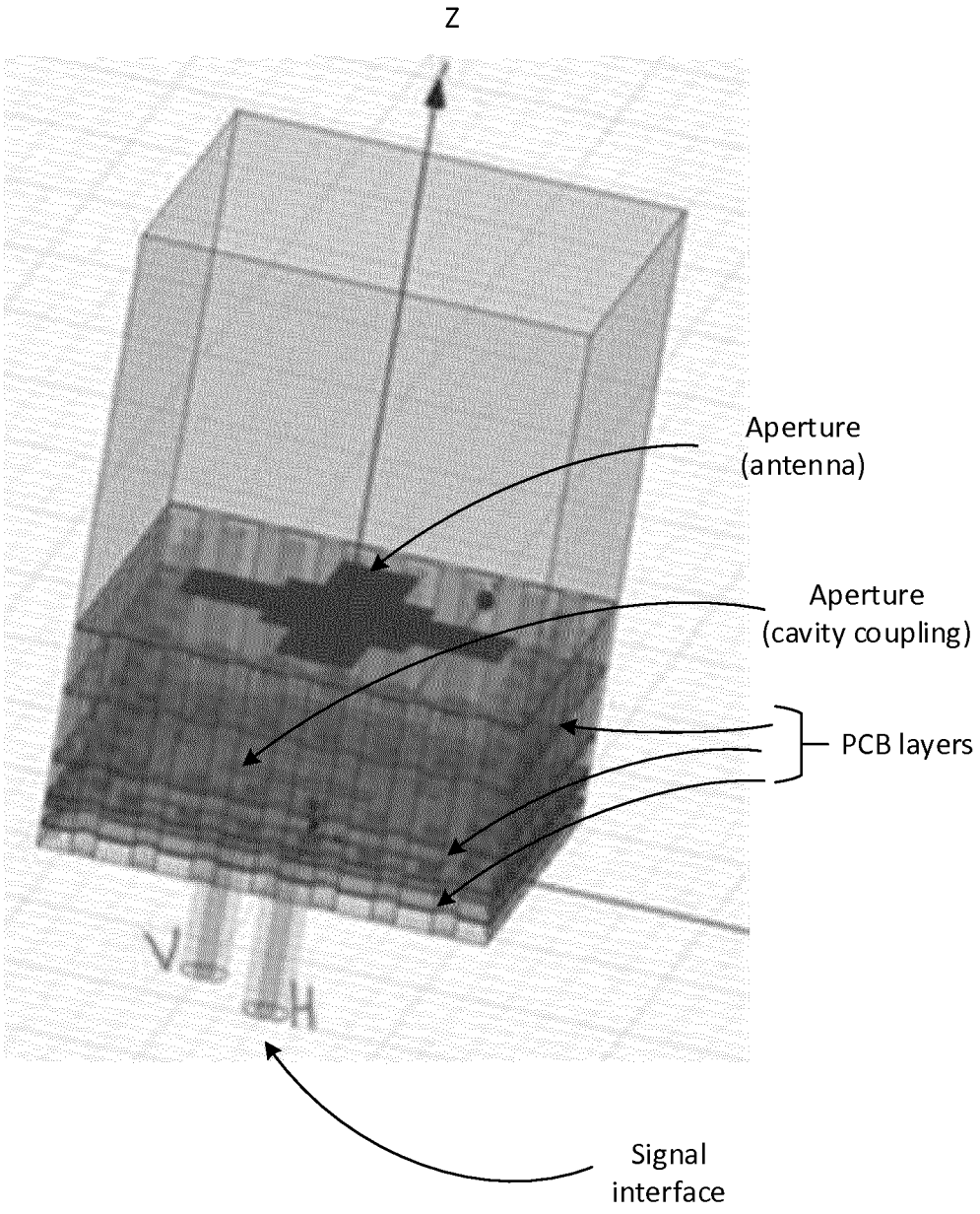
FIG. 9 illustrates a filter arrangement according to embodiments.

FIG. 9 illustrates a filter arrangement according to embodiments. The filter arrangement comprises three or more metallization layers separated by dielectric material layers, each metallization layer comprising one or more apertures. The filter arrangement comprises an electromagnetically shielded side wall extending though the stacked metallization layers and through the dielectric material layers, whereby the side wall and the metallization layers delimit a cavity in each dielectric material layer. The cavities in two consecutive dielectric material layers being coupled by the aperture in the metallization layer separating the two consecutive dielectric material layers, the aperture of a topmost metallization layer being arranged as antenna element, the aperture of a bottommost metallization layer being arranged as signal interface to the filter arrangement.

It is noted that the filter arrangement can be fed into any of the cavities. If the filter arrangement is fed via a cavity which is not arranged at an end-point of the stack, then a transmission zero will be present in the filter frequency response characteristics.

There are several advantages of the proposed filter-antenna design shown in FIG. 9, for instance;

Compact size: Two polarization states of the antenna element are realized using TE210 and TE120 degenerate modes. The footprint of the filter is identical to that of the antenna element.

Lower insertion loss: The cavities realized using a multilayered substrate stack have higher Q-factor in comparison to any other resonator (microstrip, slot-line, etc.) realized on the same substrate. Using higher order allows even higher Q-factors to be achieved, often by a price of reduced spurious-free window. However, with proper choice of the coupling arrangement there is good potential to keep parasitic passbands at low level.

Reduced sensitivity to the manufacturing tolerances is achieved by choosing a maximum size for the resonant cavities (overmolded cavity). These are larger and hence less sensitive in comparison to any other implementation of the resonator.

Response stability: The resonant frequency of each cavity TE210/TE120 is defined by its dimensions in x-y plane, i.e. it is defined by accurate placement of the via holes that establish the cavities side walls. In the proposed filter-antenna design all the resonators are using the same set of via holes. In that follows, that the effect of inaccurate placement of each via hole is identical or very similar for all the resonators. Practical importance of this fact is that the filter-antenna response due to inaccurately placed via holes will be shifted upward or downward on frequency, while return loss performance in the first approach will be not affected.

Bandwidth of the antenna element. A simple way to achieve wide frequency range is to use a cavity backed antenna element as the last resonator and the load for the filter realized in the substrate stack. The design procedure is standard and in this case the filter works as a matching circuit for antenna element. This allows great flexibility when choosing the antenna bandwidth and allows to consider the effect of manufacturing tolerances FIG. 10 is a flowchart schematically illustrating methods according to embodiments.

Figure 10:
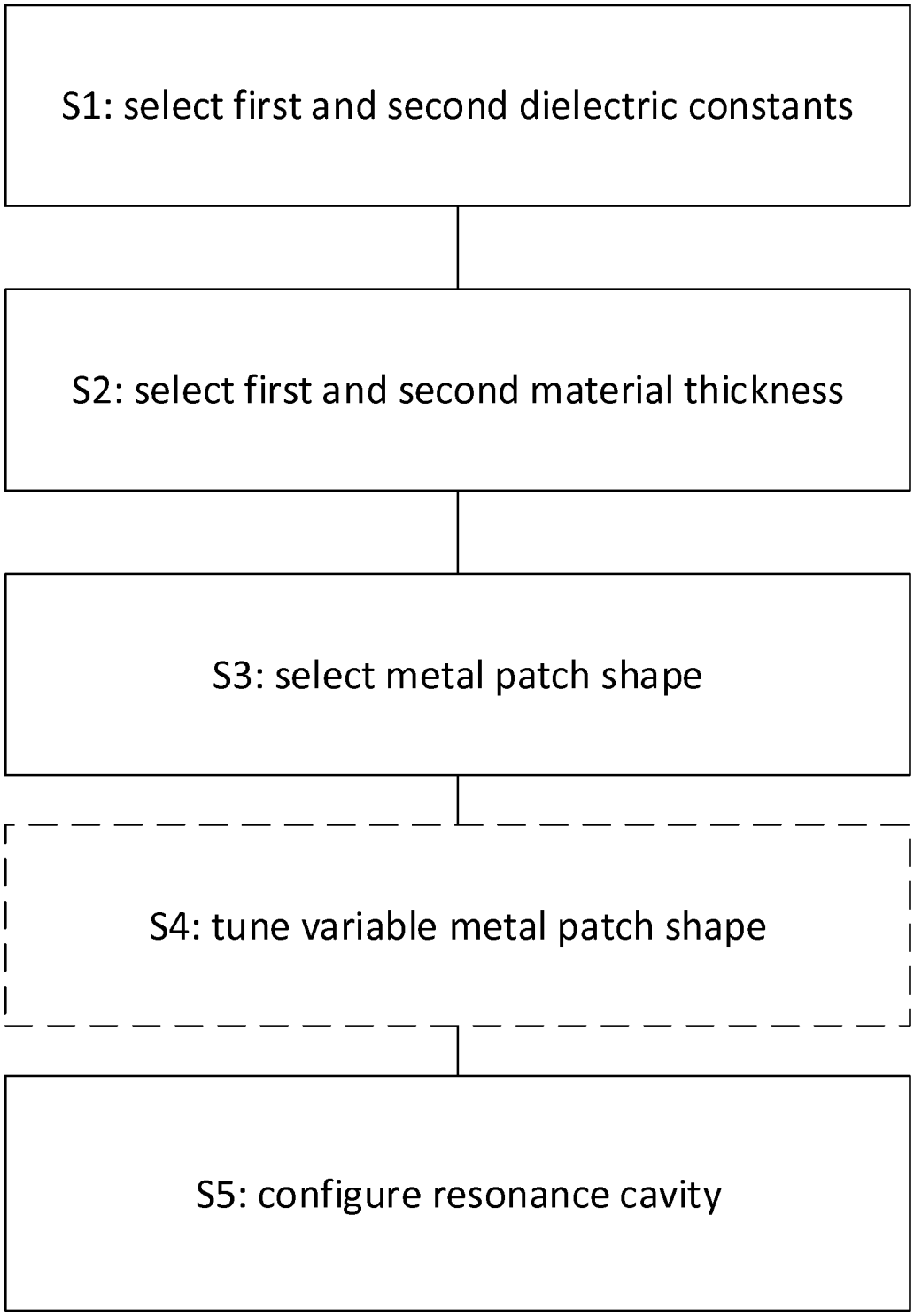
FIG. 10 is a flowchart schematically illustrating methods according to embodiments.

FIG. 10 illustrates a method for tuning a resonance frequency of a resonance cavity, comprising selecting S1 a first dielectric constant and a second dielectric constant different from the first dielectric constant, selecting S2 a first and a second dielectric material thickness, selecting S3 a metal patch shape, configuring S5 a first layer of dielectric material having the first dielectric constant and the first thickness, a second layer of dielectric material having the second dielectric constant and the second thickness, a metal patch interspersed between the first and the second dielectric layer having the selected metal patch shape, and an electromagnetically shielded enclosure having at least one aperture, the electromagnetically shielded enclosure arranged to enclose part of the first and second layers of dielectric material and the metal patch.

According to aspects, the metal patch has a variable shape controllable from an exterior of the resonance cavity, and the method comprises tuning S4 the variable shape of the metal patch to adjust the resonance frequency.

The invention claimed is:

1. A multi-layer resonance cavity comprising:

a first printed circuit board (PCB) layer of dielectric material associated with a first dielectric constant and a first thickness;

a second PCB layer of dielectric material associated with a second dielectric constant different from the first dielectric constant and a second thickness;

a metal patch having a shape arranged between the first and the second PCB layers of dielectric material; and an electromagnetically shielded enclosure having at least one aperture, the electromagnetically shielded enclosure arranged to enclose part of the first and second PCB layers of dielectric material and the metal patch, whereby a resonance frequency of the multi-layer resonance cavity is determined at least in part by the first dielectric constant, the second dielectric constant, the first thickness, the second thickness, and the shape of the metal patch.

2. The multi-layer resonance cavity according to claim 1, wherein the electromagnetically shielded enclosure comprises side walls defined by a plurality of via-holes, a topmost metallization layer applied to the first PCB layer of dielectric material and a bottommost metallization layer applied to the second PCB layer of dielectric material.

3. The multi-layer resonance cavity according to claim 1, wherein the electromagnetically shielded enclosure comprises a metallized side wall or a metallized trench, a topmost metallization layer applied to the first PCB layer of dielectric material and a bottommost metallization layer applied to the second PCB layer of dielectric material.

4. The multi-layer resonance cavity according to claim 1, wherein an opening in the topmost metallization layer is configured as one of the at least one aperture.

5. The multi-layer resonance cavity according to claim 1, wherein the electromagnetically shielded enclosure comprises a first and a second of the at least one aperture.

6. The multi-layer resonance cavity according to claim 1, comprising a third PCB layer of dielectric material associated with a third dielectric constant and a third thickness, a further metal patch arranged between the second and the third PCB layers of dielectric material, the electromagnetically shielded enclosure being arranged to enclose part of the first, second, and third PCB layers of dielectric material, the metal patch and the further metal patch.

7. The multi-layer resonance cavity according to claim 1, wherein the metal patch has a variable shape controllable from an exterior of the resonance cavity.

8. The multi-layer resonance cavity according to claim 7, wherein the metal patch is electrically connected to an electrical component arranged at an exterior of the resonance cavity, wherein the electrical component is configured to alter an equivalent electrical size of the metal patch.

9. The multi-layer resonance cavity according to claim 8, wherein the electrical component comprises a varactor.

10. A filter arrangement comprising the multi-layer resonance cavity according to claim 1.

11. An antenna element comprising the filter arrangement according to claim 10.

12. An antenna array comprising a plurality of antenna elements according to claim 11.

13. A wireless device comprising one or more antenna elements according to claim 11.

14. A method for tuning a resonance frequency of a multi-layer resonance cavity, comprising:

selecting a first dielectric constant and a second dielectric constant different from the first dielectric constant;

selecting a first and a second dielectric material thickness;

selecting a metal patch shape; and configuring a first printed circuit board (PCB) layer of dielectric material having the first dielectric constant and the first thickness, a second layer of dielectric material having the second dielectric constant and the second thickness, a metal patch interspersed between the first and the second dielectric PCB layers having the selected metal patch shape, and an electromagnetically shielded enclosure having at least one aperture, the electromagnetically shielded enclosure arranged to enclose part of the first and second PCB layers of dielectric material and the metal patch, wherein the resonance frequency of the multi-layer resonance cavity is determined at least in part by the first dielectric constant, the second dielectric constant, the first dielectric material thickness, the second dielectric material thickness, and the metal patch shape.

15. The method according to claim 14, wherein the metal patch has a variable shape controllable from an exterior of the resonance cavity, and wherein the method comprises tuning the variable shape of the metal patch to adjust the resonance frequency.

* * * * *